United States Patent [19]

Hart

[11] 4,260,195

[45] Apr. 7, 1981

[54] CONTOUR MINER

[75] Inventor: Gwyn G. Hart, Shady Spring, W. Va.

[73] Assignee: John M. Daniel, Beckley, W. Va.

[21] Appl. No.: 42,584

[22] Filed: May 24, 1979

[51] Int. Cl.[3] ..... E21C 5/06; E21C 25/06; E21D 15/02

[52] U.S. Cl. ..... 299/11; 299/18; 299/17; 299/31; 299/33; 299/52; 405/288

[58] Field of Search ..... 405/288; 299/18, 31, 299/33, 42, 43, 19, 11, 10, 51, 52

[56] References Cited

U.S. PATENT DOCUMENTS

| | | | |
|---|---|---|---|
| 3,169,796 | 2/1965 | Long et al. | 299/31 |
| 3,677,603 | 7/1972 | Small | 299/31 |
| 3,834,762 | 9/1974 | Kakajima | 299/43 |
| 4,017,122 | 4/1977 | Simpson | 299/11 |
| 4,099,786 | 7/1978 | Kakajima | 299/43 |
| 4,183,586 | 1/1980 | Owen | 299/18 |

*Primary Examiner*—William F. Pate, III

*Attorney, Agent, or Firm*—Mason, Fenwick & Lawrence

[57] ABSTRACT

A contour miner has walker means carrying an external deck outside the formation being mined having power supply and control means for movement along the periphery of a coal seam with a reciprocating carriage having a rotary cutter for removing the coal from a work face extending inwardly below the overburden perpendicular to the seam periphery; a conveyor extends adjacent the work face and conveys the removed coal out beyond the external deck; an internal roof support-walker assembly is positioned inwardly of the formation and has hydraulic cylinder actuated movable roof supports and ground pads and hydraulic cylinders for walking forward toward the work face with dragline means moving prefabricated roof supports behind the support-walker assembly as it is moved toward the work face.

29 Claims, 15 Drawing Figures

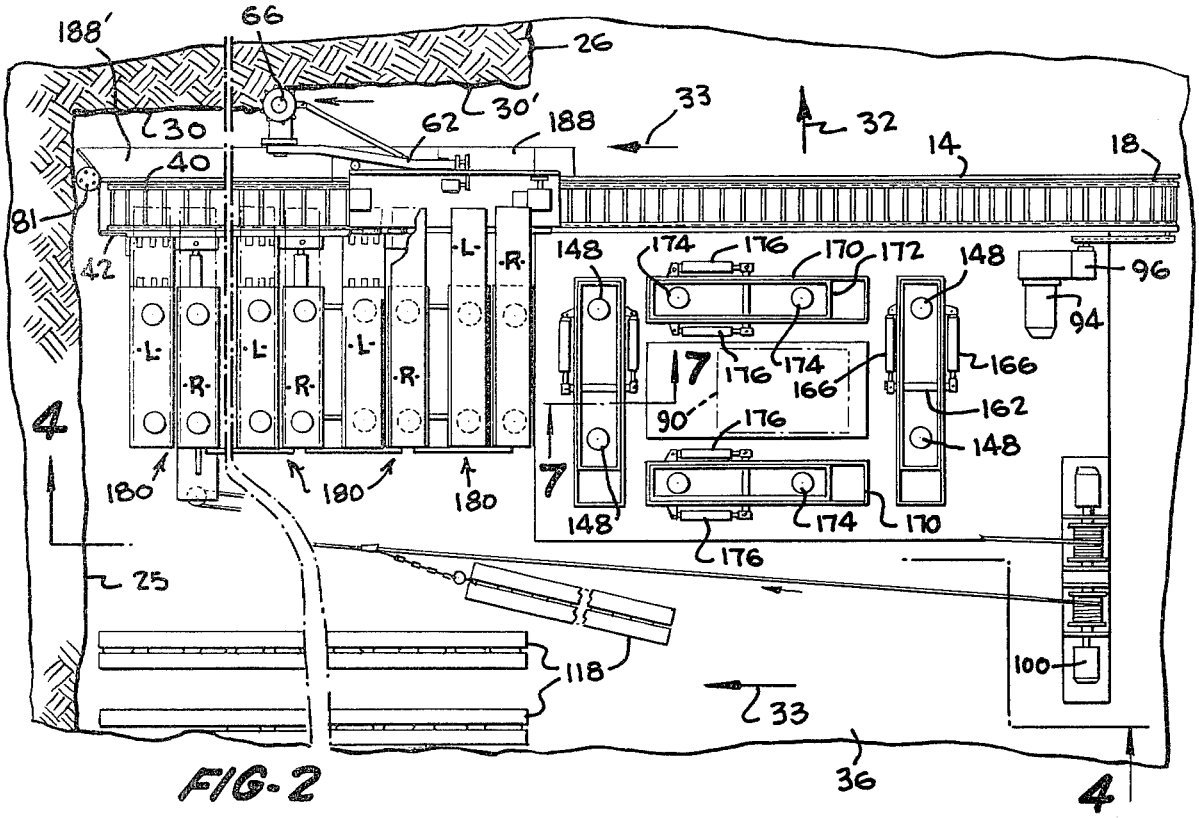
FIG-2
FIG-3
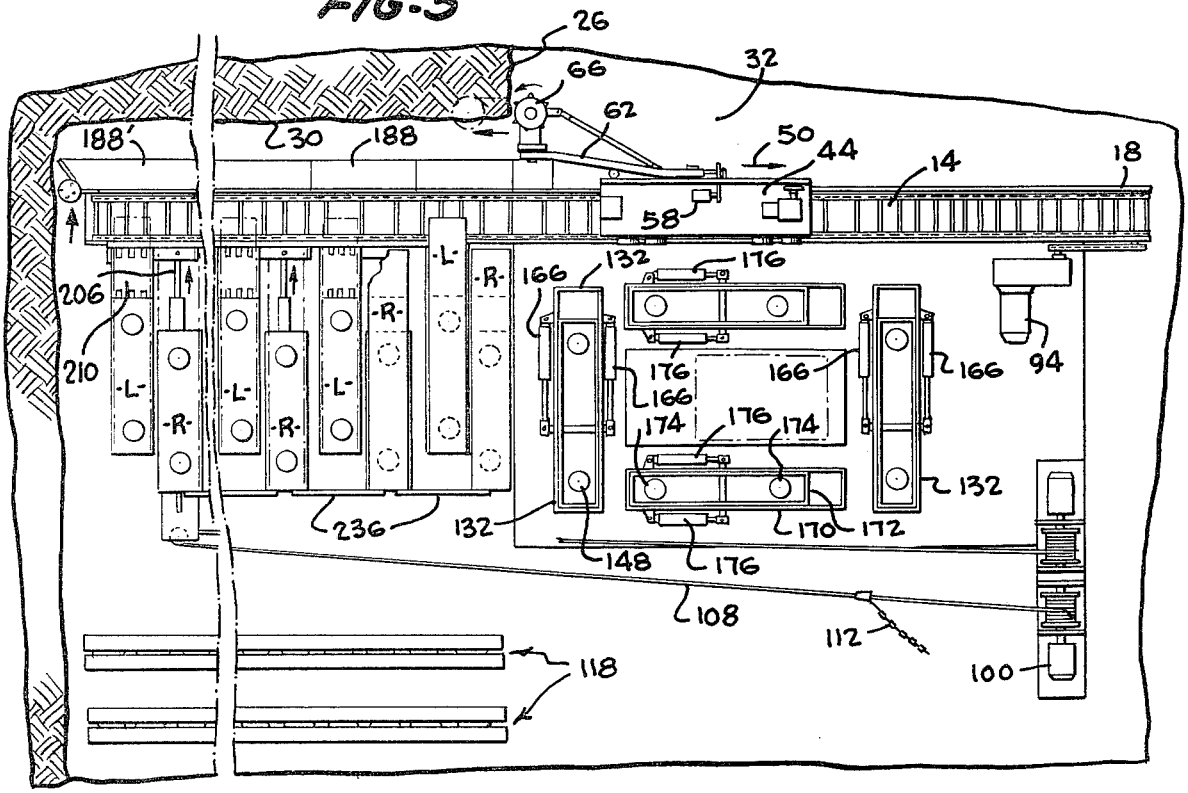

CONTOUR MINER

This invention is in the field of mining equipment and is more particularly directed to a contour mining machine to be used for mining coal or the like which would otherwise be mined by strip mining or augering procedures. It is well known that strip mining, while one of the most efficient ways of removing coal from the earth, also creates great problems with the environment. As a consequence of the foregoing, strip miners are required to return the environment to its original condition to the fullest extent possible. However, it is sometimes impossible to return the land to its original condition; for example, there is no way in which a full grown forest can be replaced without the passage of many years time. Additionally, the reclamation necessary following a strip mining operation is always expensive and it consequently substantially increases the cost of a strip mining operation.

On the other hand, the conventional augering procedures for mining coal do not disturb the environment nearly as much as strip mining. Unfortunately, the augering procedures leaves 40 to 50% of the coal in the ground and are consequently quite inefficient in this regard.

Therefore, it is the primary object of this invention to provide a new and improved mining apparatus for use in place of strip mining and augering.

Achievement of the foregoing object is enabled through the preferred embodiment which comprises a mining machine movable along the contour of a hill, mountain or other formation adjacent the edge of a coal seam. The machine includes a movable external deck assembly which provides hydraulic and pneumatic power and control and a support-walker assembly extending into the hill beneath the overburden. Both the external deck assembly and the support-walker assembly include hydraulic cylinder controlled walking members with the support-walker assembly additionally including hydraulic controlled roof support members. A coal removing conveyor extends along the forward end of the machine and has a discharge end externally of the formation adjacent the external deck with the inner end of the conveyor extending into the formation up to a position adjacent the work face of the coal seam being mined. A carriage is reciprocated adjacent the work face and carries a rotary cutter head which removes the coal from the work face from which it falls downwardly onto the conveyor or onto the floor of the mine for subsequent removal onto the conveyor. The support-walker assembly comprises a plurality of walking units each consisting of two roof support pads and two ground pads joined by a pair of vertical hydraulic cylinders. The ground pads are additionally connected by hydraulic cylinders for moving them substantially apart further into the formation if required. Additionally, hydraulic cylinder means connects the right ground pad and right roof support of each walking unit to the conveyor for moving the conveyor forwardly while concurrently pulling the left ground pad and the left roof support pad forwardly with the conveyor. The external deck assembly is also moved forwardly at the same time by walking pontoon means provided with the deck assembly. The right roof support and ground pad of each of the walking units is then pulled forwardly simultaneously to bring the components into their original condition to permit a subsequent removal of the coal from the work face. The number of walking units employed will vary with the depth of the coal seam to be removed and additional units can easily be added. Additionally, control of the components inside the formation beneath the overburden is enabled from outside the mining area by means of a television camera positioned to inspect the most important aspects of the operation such as the operation of the rotary cutter head.

A better understanding of the manner in which the preferred embodiment achieves the foregoing objects will be obtained when the following detailed description is considered in conjunction with the appended drawings in which:

FIG. 2 is a plan view of the preferred embodiment with the cutter head operating to effect removal of coal from a coal seam with the overburden being removed for clarity of illustration;

FIG. 3 is a plan view similar to FIG. 2 but illustrating the components in a subsequent position with the components having been moved in a forward direction toward the top of the sheet from their FIG. 2 position;

Figure 4:
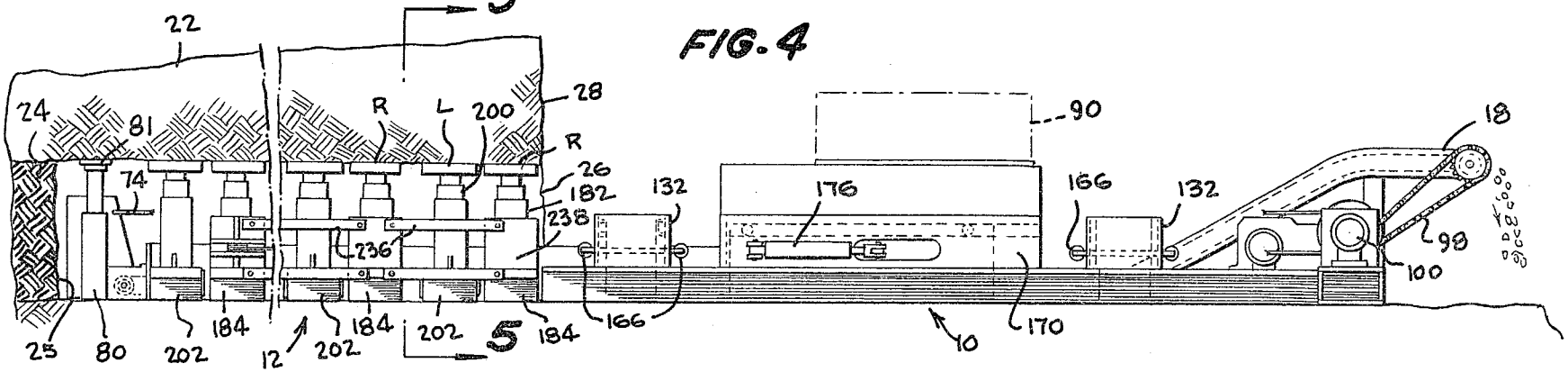
FIG. 4 is a sectional view taken along lines 4—4 of FIG. 2.

The two basic components of the preferred embodiment of the invention comprise a movable external deck assembly 10 located outside the formation being mined and an internal support walker assembly generally designated 12 located inside the formation with a conveyor 14 extending adjacent a forward portion of both the support-walker assembly 12 and the movable external deck assembly 10. Conveyor 14 includes an inner end 16 and an outer or discharge end 18. The support-walker assembly 12 is normally positioned completely within the confines of the formation being mined with the external deck assembly 10 being positioned externally of the formation as best shown in FIGS. 2 and 4. The formation includes an overburden 22 and a coal seam 24 having an outer peripheral edge 26 coextensive with the peripheral edge 28 of the overburden as best shown in FIG. 4. The coal seam 24 includes a work face 30 (FIG.

2) from which the coal is removed by means to be discussed.

The entire unit is designed to move along the peripheral face 26 of the coal seam in a first or forward direction of movement indicated by arrow 32 in FIG. 2. The entire unit moves in a horizontal direction along the contour of the periphery of the formation such as along the side of a hill with the external deck member 10 being supported by a terrace 36 provided by conventional earthbuilding equipment such as bulldozers or the like.

Conveyor means 14 includes first and second side rails 40 and 42 which support a carriage 44 by means of wheels 46 for reciprocation in a second direction of movement 33 perpendicular to the first direction of movement 32. The movement of the carriage 44 is consequently inwardly and outwardly with respect to the formation. The outer extent of movement possible for the carriage is illustrated in FIG. 3.

Figure 11:
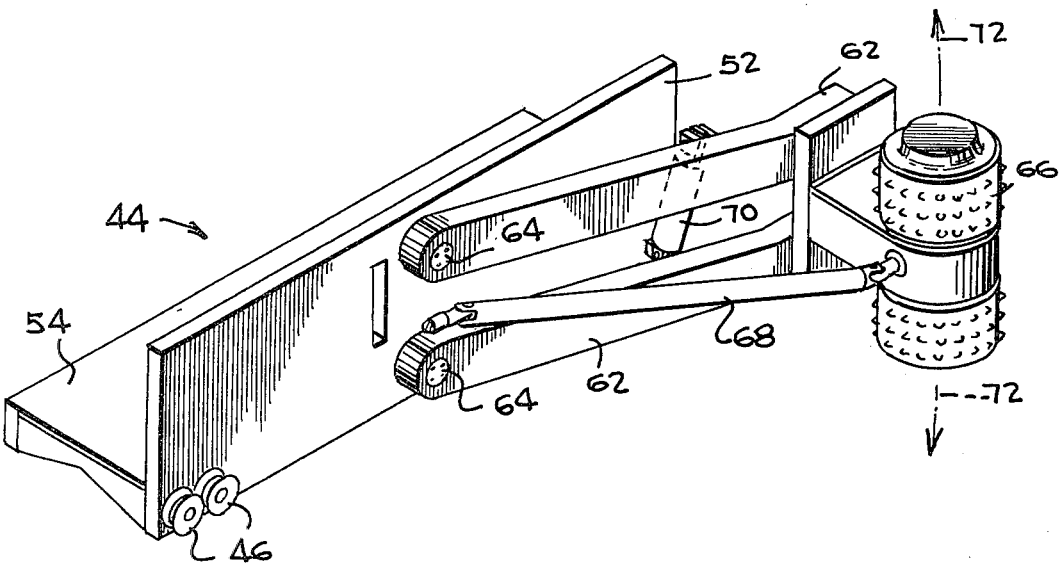
FIG. 11 is a perspective view of a cutter head carriage means of the preferred embodiment.
Figure 12:
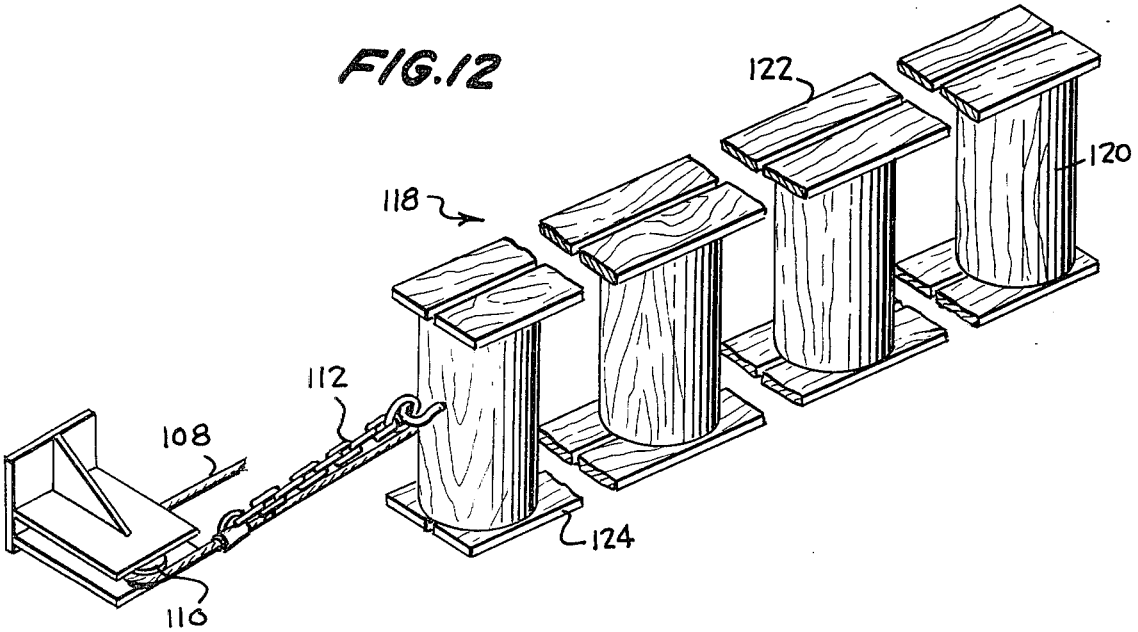
FIG. 12 is a perspective view of roof support placement means of the preferred embodiment.

Carriage 44 as shown in FIG. 11 includes a main vertical plate 52 and a horizontal bed frame 54 which supports a carriage drive motor 56, a rotary cutter head drive motor 58 and a television camera housing 60. A pair of parallel cutter head support arms 62 are mounted for pivotal movement about horizontal pivot axes 64 on the main vertical plate 52 with the outer ends of the arms 62 providing support for a rotary cutter head 66. Drive to the rotary cutter head 66 is provided from the cutter head drive motor 58 by means of a power transmission shaft 68 through universal couplings. A cutter head elevator cylinder 70 is connected between the main vertical frame component 52 and the uppermost support arm 62 to adjust the vertical height of the cutter head 66 in the direction of arrows 72 as shown in FIG. 11. Power to the motors on the carriage is provided by trailing cables or trolley type pickup means (not shown).

Figure 1:
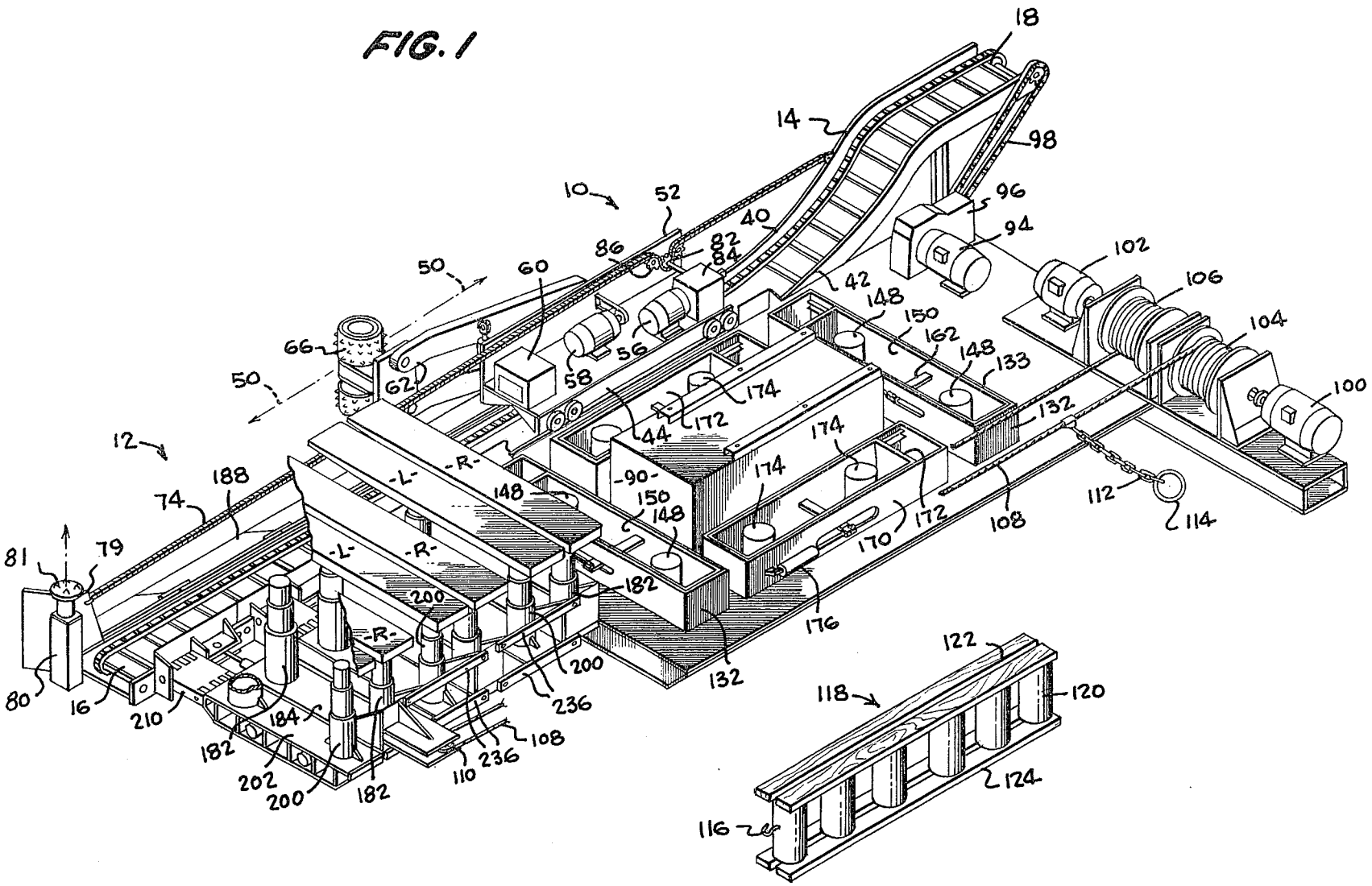
FIG. 1 is a perspective view of the preferred embodiment of the invention.
Figure 6:
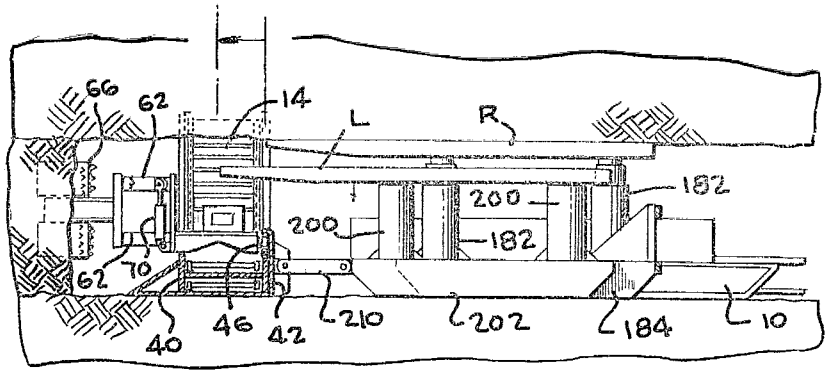
FIG. 6 is a sectional view similar to FIG. 5 but illustrating the components in the subsequent position of FIG. 3.

A horizontal reaction chain 74 extends adjacent the main vertical plate 52 and has its inner end connected to a frame plate 79 adjacent a corner stabilizer jack 80 having a roof engaging anchor plate 81 and its outer end connected to the frame of the conveyor 14 near the discharge end 18 thereof. A sprocket 82 on the output shaft of a step-down transmission 84 driven by carriage drive motor 56 is positioned in a downwardly extending loop of the chain 74 between idler sprockets 86 as shown in FIG. 1. Operation of motor 56 in one direction serves to move the carriage inwardly between an outer position illustrated in FIG. 3 to an inner position in which the rotary cutter head 66 is adjacent the inner face 25 of the coal seam 24.

The external deck assembly 10 provides support for a housing 90 (FIG. 2) of desired shape and size enclosing hydraulic and electrical components such as pumps, motors and electrical and hydraulic controls. Additionally, additional housing components can also be provided as required for the particular installation.

Drive for conveyor 14 is provided by a conveyor drive motor 94 which drives a step-down transmission 96 having an output shaft provided with a sprocket engaging a drive chain 98 for driving the conveyor 14 in an obvious manner. Jack 80 includes a hydraulic cylinder for moving the anchor plate 81 into engagement with the lower surface of the overburden 22 as shown in FIG. 4. The external deck assembly 10 additionally includes first and second winch motors 100 and 102 respectively driving first and second winch members 104 and 106 to which a cable 108 is connected. Cable 108 extends over an idler pulley 110 mounted on the support-walker assembly 12 as shown in FIG. 1 and includes a drag chain 112 having a connector ring 114 which is engageable with hook means 116 on roof support members 118 which consist of vertical timbers 120 and upper and lower planks 122 and 124. The purpose of the cable 108 and associated winches etc. is to position the roof supports 118 beneath the overburden 22 in a manner that will be discussed hereinafter.

Figure 7:
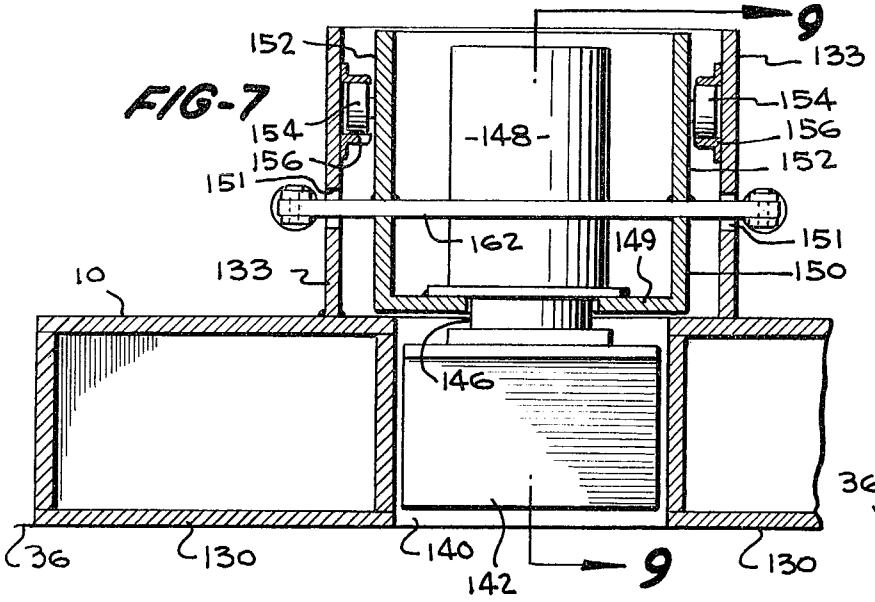
FIG. 7 is a sectional view taken along lines 7—7 of FIG. 2.
Figure 9:
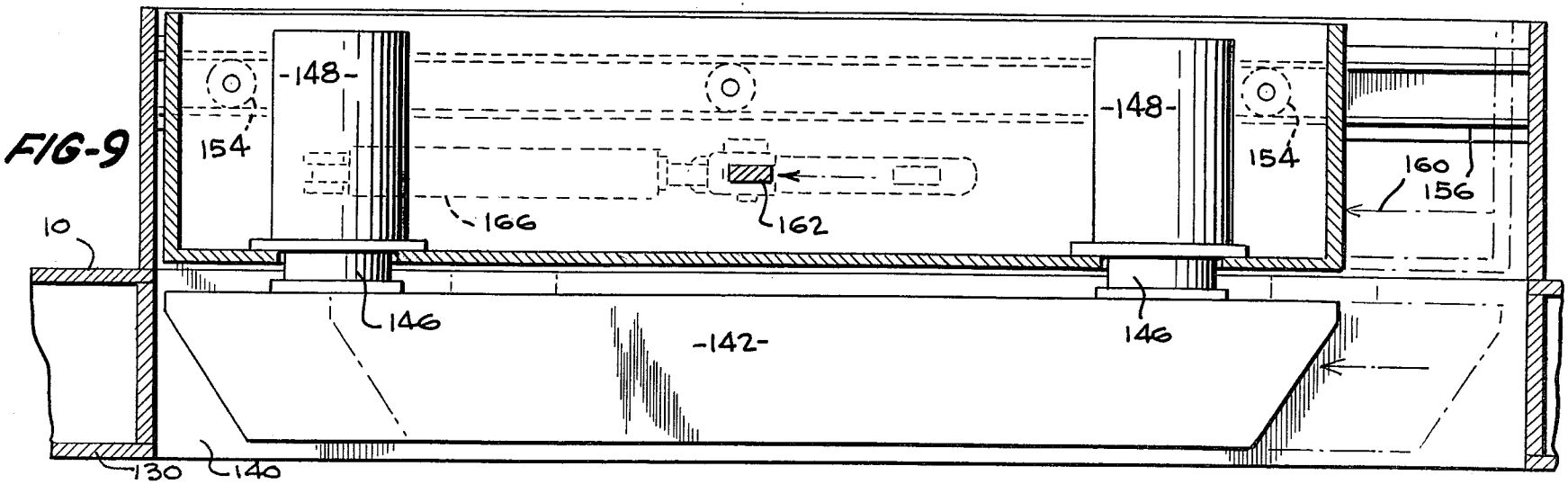
FIG. 9 is a sectional view taken along lines 9—9 of FIG. 7.

Drive means is provided for moving the external deck assembly 10 in the forward or first direction 32 or in the second direction 33 perpendicular to direction 32; the drive means can also move the components in directions which are reverse to directions 32 and 33. Specifically, deck 10 includes a rigid framework having fixed bottom plates 130 which normally provide support for the deck assembly on supporting surface 36 as shown in FIGS. 7 and 9. A first pair of parallel elongated fixed box frames 132 extend upwardly from the deck as shown in FIG. 1 with the box frames enclosing pontoon receiving openings 140 in which elongated walker pontoons 142 are mounted. The pontoons 142 are connected to the lower ends of piston rods 146 of a pair of lift cylinders 148 which are in turn supported on and fixed to the bottoms 149 of movable carrier box frames 150 each one of which is respectively positioned on the interior of one of the fixed box frame members 132. The carrier box frames 150 have sidewalls 152 on which carrier rollers 154 are mounted. The carrier rollers are positioned in guide tracks 156 on the inner surface of the sidewalls 133 of the fixed box frame members 132. Since the carrier box frames 150 are of less length than the fixed box frame members 132, a certain amount of relative axial movement between the box frame members 150 and 132 is permissible as shown by the arrow 160 in FIG. 9. The sidewalls 133 are provided with slots 151 through which a transverse drive bar 162 extends. Drive bar 162 is welded to the sidewalls 152 of the carrier box frame 150 and the rods of hydraulic cylinders 166 (FIG. 2) are connected to the respective outer ends of the drive bar 162 with the cylinders themselves being mounted on the walls 133 of the fixed box frame members 132. Expansion and contraction of the cylinders 166 consequently serves to reciprocate the drive bar 162 along the length of slots 151 to consequently move the carrier box frame 150 within the confines of the outer fixed box frame 132 with such movement also moving the lift cylinders 148 and the pontoons 142.

Prior to movement of the external deck assembly 10 in the direction of arrow 32, the lift cylinders 148 are normally in retracted condition and hold the pontoons 142 in their upper position illustrated in FIGS. 7 and 9 so that the deck assembly rests upon the fixed bottom plates 130 and the cylinders 166 are in contracted condition with the carrier box frame being positioned in the fixed box frame 32 as illustrated in FIG. 2. It is also possible to partially or completely support the deck by the pontoons prior to movement. In any event, cylinders 148 are then fully extended to lift the deck 10 upwardly so that the fixed bottom plates 130 are spaced above the supporting surface in the positions illustrated in FIG. 8. Cylinders 166 are then extended to cause the deck 10 to be shifted to the left in the direction of arrow 160 to the position illustrated in FIG. 3 to the full extent of movement permitted by the geometry and dimensions of the parts. Cylinders 148 are then contracted to lower the deck downwardly and lift pontoons 142 so that the deck is again supported by the fixed bottom plates 130. Cylinders 166 are then contracted to move the carrier box frame 150, cylinders 148 and pontoons 142 back to the solid line position of FIG. 9 (and FIG. 1) in readiness for the next movement of the deck which is effected by repeating the foregoing steps.

Similarly, movement of deck assembly 10 in direction 33 perpendicular to direction 32 is permitted by a second pair of pontoon walkers comprising fixed box frames 170, carrier box frames 172, lift cylinders 174 supporting pontoons and drive cylinders 176 all of which are identical to the previously discussed box frame 132, carrier box frame 150 etc. and which operate in the exact same manner but which by virtue of their different orientation, are operated for moving the deck 10 in direction 33 perpendicular to direction 32. Obviously, when the means 170 etc. is used for moving the deck in direction 33, it is necessary for the corresponding pontoons 142 to be retracted. Similarly, when the first movement effecting means 132 etc. is operated for moving in direction 32, the lift cylinders 174 are contracted to lift their associated pontoons (not illustrated) out of contact with the supporting surface.

Figure 10:
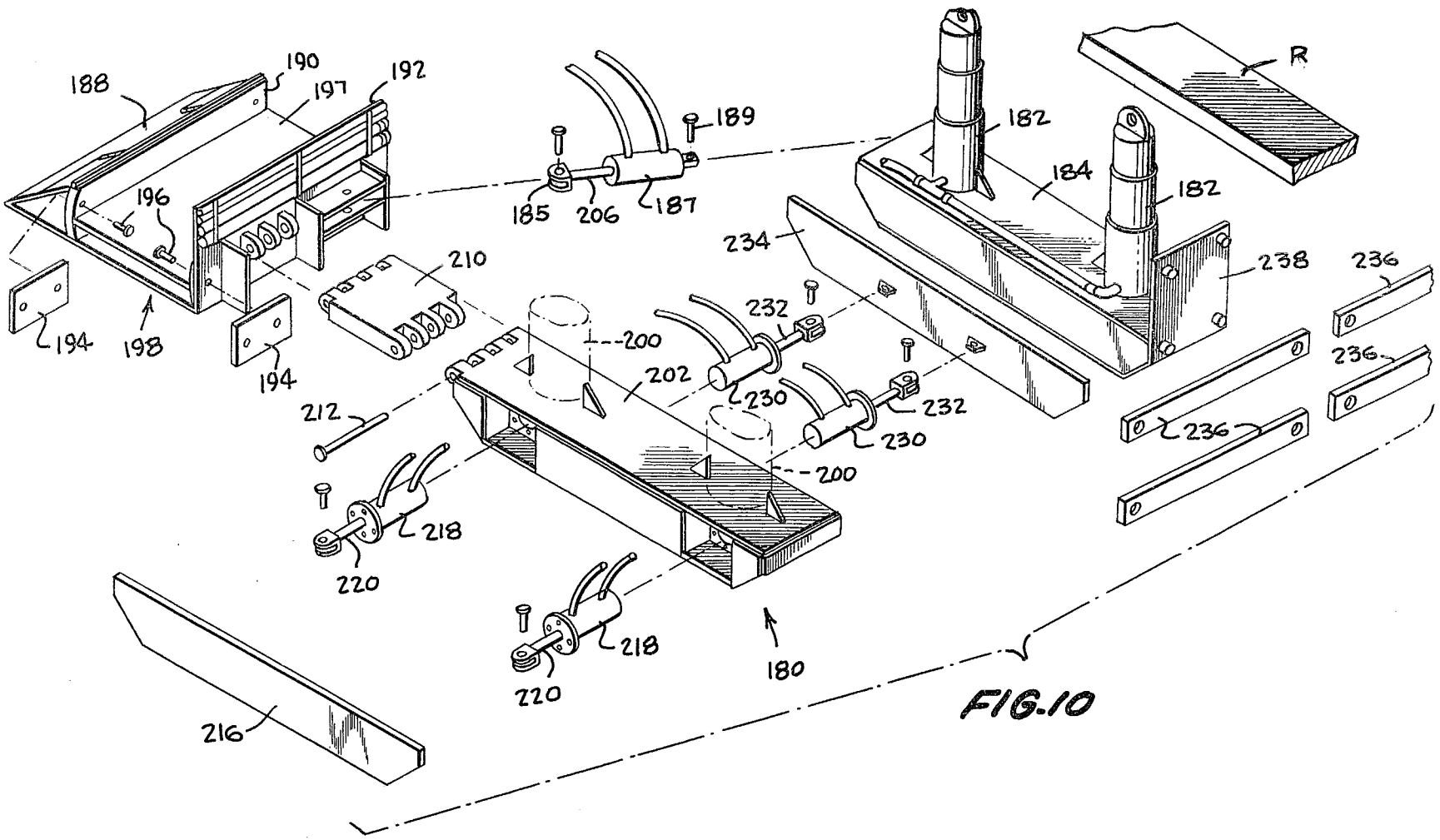
FIG. 10 is an exploded perspective view of a walking unit component of a support-walker portion of the preferred embodiment.

Movement of the support-walker assembly 12 in forward direction 32 is accomplished simultaneously by a plurality of walking units 180 of identical construction best shown in FIG. 10 each consisting of a left roof support pad L and a right roof support pad R with the terms "left" and "right" being as viewed in FIG. 2 of the drawings. The right roof support pads R are supported by the rods of hydraulic cylinders 182 while the left roof pads pairs L are supported by the rods of hydraulic cylinders 200. The lower ends of the right hydraulic cylinders 182 are mounted on right ground pads 184 while the lower ends of the left hydraulic cylinders 200 are mounted on left ground pads 202. It will be observed that the number of walking units 180 will vary with the extent to which the mining operation extends in direction 33 into the formation. In FIG. 2, four of the walking units are illustrated.

FIG. 10 best illustrates the walking unit components with the forward end of each of the walking units consisting of a panline conveyor frame unit generally designated 198 having a canted scoop plate 188 on its forward end and having vertical plates 190 and 192 defining a trough 197 through which the conveyor 14 extends with adjacent panline frame units being connected to each other by pivot plates 194 and pivot bolts 196. Each panline conveyor frame unit 198 is connected to its associated left ground pad 202 by a drag link plate 210 and associated pins 212. The right ground pad is connected to the panline conveyor frame unit 198 by a clevis and pin 185 on the rod of a panline pusher jack 187 mounted by a pivot pin 189 internally of the right ground pad 184. It should be observed that the panline pusher jack 187 is capable of pivotal movement with respect to the right ground pad.

Each of the walking units 180 is separated from the next unit by a pusher plate 216 provided to the left of the left ground pad 202. Walking unit push cylinders 218 are mounted in the left ground pads 202 and have their rods 220 connected to the adjacent pusher plate 216. Additionally, ground pad pusher jacks 230 are mounted in the left ground pad 202 and have their rods 232 connected to a separator pusher plate 234 positioned between the adjacent ground pads 184 and 202 of each respective walking unit. Additionally, a drive connection is provided between adjacent walking units 180 by means of connector links 236 connected between bracket plates 238 on each of the right ground pads 184.

Figure 5:
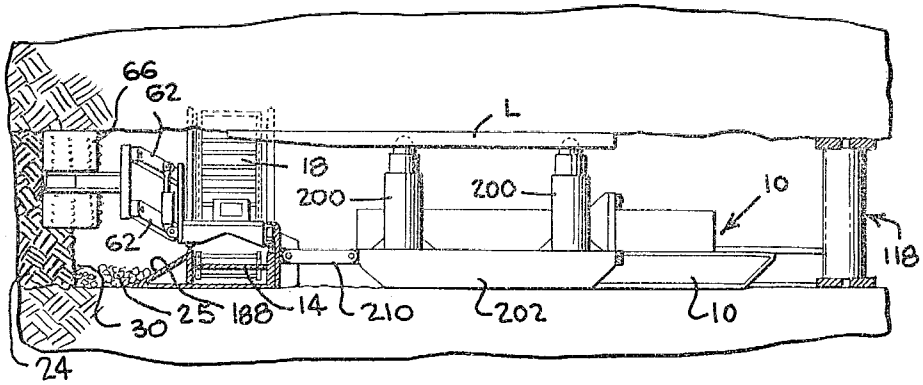
FIG. 5 is a sectional view taken along lines 5—5 of FIG. 4.
Figure 13:
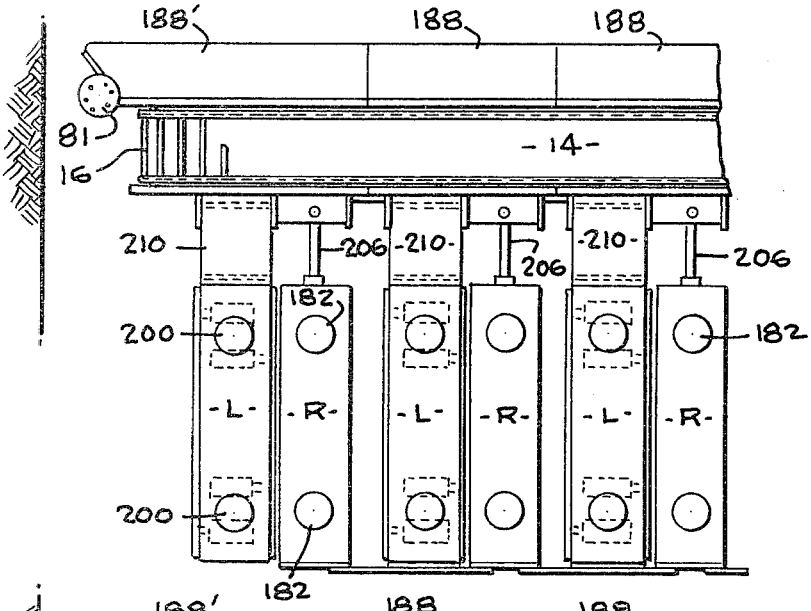
FIG. 13 is an exploded plan view of the support-walker portion of FIG. 2.

A complete cycle of operation will now be discussed with it being understood that the components are initially positioned as shown in FIGS. 1, 2 and 13. The rotary cutter head 66 is traversed along the work face 30 by operation of the motor 56 to cut away the coal and provide a new work face 30' as shown in FIG. 2. If the height of the coal seam 24 exceeds the vertical height of the rotary cutter head 66, it will be necessary for the cutter head 66 to make more than one pass along the work face 30 to provide a complete new work face 30' extending along the entire height of the coal seam. The vertical position of the rotary head is adjusted between such passes by pivotal movement of the connector head support arms 62 by action of the cutter head elevator cylinder 70 in an obvious manner. The rotation of the cutter head in engagement with the work face provides a quantity of coal 25 piled in front of the canted scoop plates 188 as shown in FIG. 5. Some of the coal falls onto conveyor 14. When the rotary cutter head 66 completes removal of the old work face 30 to provide a new work face 30' extending the entire vertical height of the coal seam, it is then necessary to move the apparatus forward toward the new work face 30'. Such movement is effected by simultaneously moving the external deck assembly 10 and the support-walker assembly 12 forwardly in coordinated manner.

Figure 8:
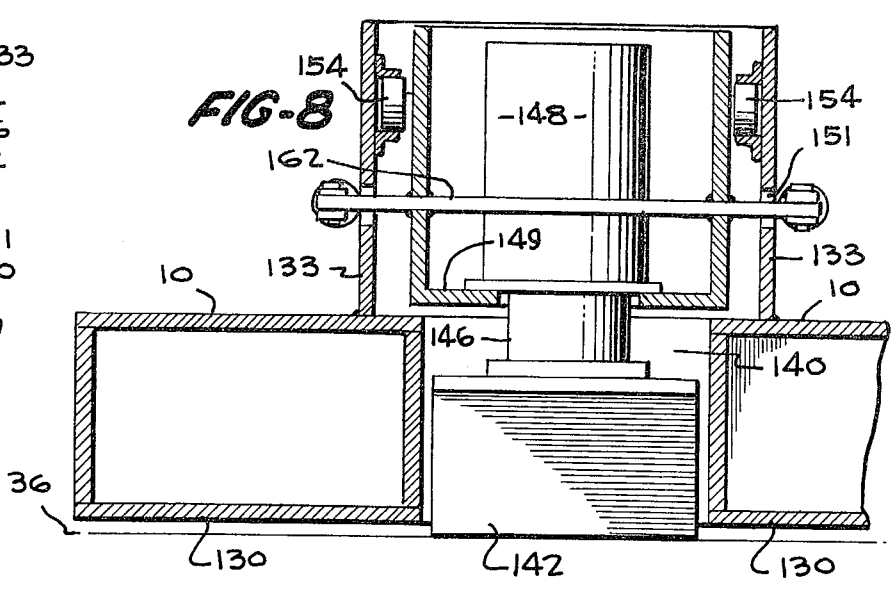
FIG. 8 is a sectional view similar to FIG. 7 but illustrating the components in a different position of orientation corresponding to the position of FIG. 3.

Forward movement of the entire apparatus begins with the extension of lift cylinders 148 to move pontoons 142 into contact with the supporting ground so as to lift the bottom plates 130 of the deck assembly 10 from the supporting ground surface as shown in FIG. 8. The lift cylinders 174 remain contracted so as to hold their pontoons in the up condition. The left hydraulic cylinders 200 of each of the walking units 180 are contracted to lower the left roof supports L while the right roof supports R remain in supporting engagement with the lower face of the overburden 22. The components are thusly in position ready for the first step in the forward movement toward the new work face 30' which begins with expansion of the panline pusher jacks 187 coupled with the simultaneous coordinated expansion of cylinders 166 from their position of FIG. 2 to their position of FIG. 3 which serves to shift the entire deck assembly, with the exception of the pontoons 142, lift cylinders 148 and carrier box frame 150 and drive bar 162. Such movement also serves to move the conveyor 14 in the direction of arrow 32 while the simultaneous expansion of the panline pusher jacks 187 serves to move the inner portion of the conveyor 14 inside the mine forwardly in the same manner so that the entire conveyor unit is moved simultaneously in the direction of the arrow 32 to the position of FIG. 3. Additionally, the forward movement accomplished inside the mine serves to scoop the coal 25 upwardly along the canted scoop plate 188 and thence onto the conveyor 14 for removal from the mine in an obvious manner. Thus, the components as illustrated in FIG. 3 have accomplished the forward movement necessary to position the conveyor and cutter head 66 to be ready to begin the next cutting operation.

Before the next cutting operation begins, it is necessary to bring the pontoons 142 etc. forward to their initial position and to similarly bring the right roof support plates R and the right hydraulic cylinders 182 and the right ground pads 184 forwardly in order to be positioned for the next forward movement of the apparatus. This movement is accomplished by first actuating the left hydraulic cylinders 200 to cause the left roof supports L to engage the roof. The right hydraulic cylinders 182 are then contracted to move the right support pads R downwardly and the lift cylinders 148 of the outer deck 10 are simultaneously contracted to lift the pontoons 142 to their upper position illustrated in FIG. 7 with the upper deck assembly consequently being lowered to be supported by the bottom plates 130. The panline pusher jacks 187 are then contracted to pull the right ground pads 184 and the right roof support pad R forwardly into alignment with the left roof support pad L and the left ground pad 202 with the cylinders 166 being simultaneously contacted to pull the pontoons 142 forward; cylinders 182 are extended to engage the right roof support pads R into engagement with the overburden. Upon the completion of the foregoing movement, the parts have been returned to the position illustrated in FIG. 2. The winch 106 is actuated to pull a new roof support 118 into position behind the support-walker assembly 12 to provide support for the overburden 22 which will eventually settle downwardly on the roof supports as the mining assembly moves forward.

Figure 14:
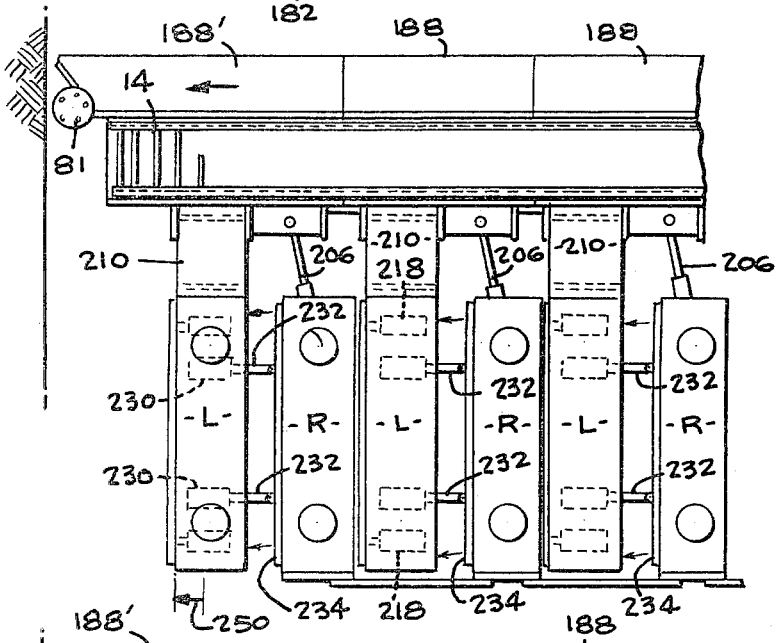
FIG. 14 is a plan view similar to FIG. 13 but illustrating some of the parts in a subsequent position of movement into the formation.
Figure 15:
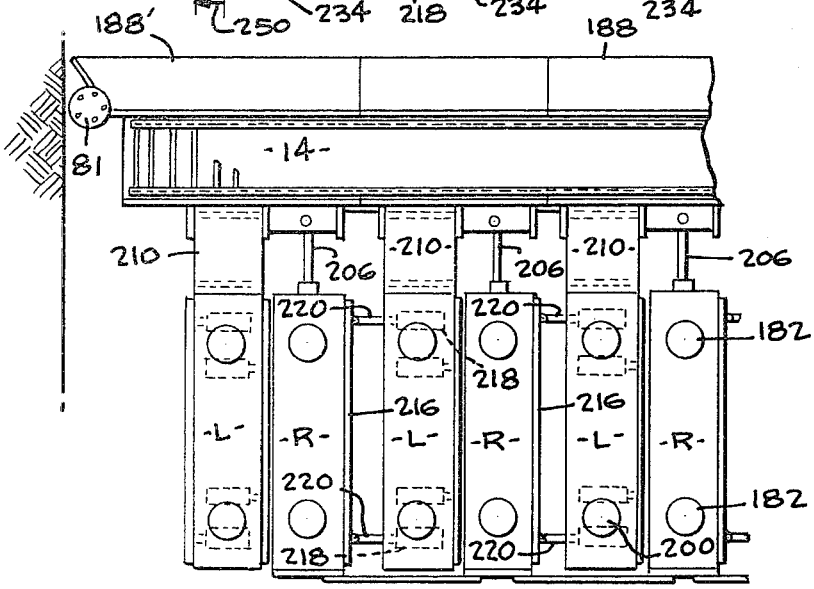
FIG. 15 is a plan view similar to FIG. 14 but illustrating the parts in a subsequent position of movement.

Additionally, it is sometimes necessary to move the walking unit 180 inwardly of the mine such as to the left in direction 33 from the positions shown in FIGS. 4 and 13. Such movement is effected by first lowering the left roof support pads L while the right roof support pads R remain in their upper position. The ground pad pusher jacks 230 in are then extended to move the left roof support pad L and its associated hydraulic cylinders 200 and the left ground pad 202 to the left by an increment of movement 250 to the position shown in FIG. 14. It will be observed that the pivotal connection of the rod 206 and cylinder 187 to the right portion of each panline conveyor frame unit 198 pivots the rod 206 as shown in FIG. 14. The left hydraulic cylinders 200 are then extended to move the left roof engaging pads L upwardly into contact with the roof. The right roof engaging pads R are then lowered and the walking unit push cylinders 218 are extended with cylinders 230 being contracted to move the right roof support pads etc. to the left to bring them into contact with the left pads L etc. so that the parts are moved to the position illustrated in FIG. 15. The walking unit push cylinders 218 are then contracted to return the pusher plates 216 to their position illustrated in FIG. 13 with all of the components being as shown in FIG. 13. Consequently, all of the walking units will have been moved to the left. The outer deck 10 can also simultaneously be moved to the left by operation of the cylinders 174 and their associated pontoons in exactly the same manner as the cylinders 148 were operated for forward movement.

In some instances, it will be desired to add additional walking units 180 which can easily be moved in position following the leftward movement of the previously installed walking units. All that is necessary is to move the previously installed walking units to the left by a sufficient amount to provide space between the rightmost unit and deck 10 for an additional walking unit. Obviously, such leftward movement will necessitate several cycles of operation of the foregoing type in order to provide adequate space for the new walking unit. Also, the conveyor will need an additional unit to make it sufficiently long.

Another feature of the invention resides in the fact that the unit can be swung about the stabilizer 80 when it is necessary to turn the unit to follow the periphery of a curved hillside or the like on which the unit is being operated; such movement is effected by coordinated movement of the drive means.

Thus, the present invention provides a completely automatic apparatus which can be monitored from outside the mining area by means of the TV camera provided in housing 60. There is no need to remove the overburden 22 and there is consequently very little rehabilitation necessary following the completion of a mining operation. The overburden and associated trees and vegetation merely settle down onto the supports 118 which will eventually, but slowly, permit full settling of the overburden without noticeable damage to the environment.

Numerous modifications of the disclosed preferred embodiment will undoubtedly occur to those of skill in the art and it should be understood that the spirit and scope of the invention is to be limited solely by the appended claims.

I claim:

1. A contour miner for movement along the periphery of a coal seam for removing coal from a work face perpendicular to the periphery of the seam to a desired depth inwardly of the periphery, said miner comprising:

a movable external deck assembly positioned on a supporting surface externally of the formation outwardly of the periphery of a coal seam to be mined;

external deck forward drive means for moving a forward end of the external deck in a first direction generally parallel to the outer peripheral surface of the seam;

external deck inward-outward drive means for moving the external deck in a second direction substantially perpendicular to the first direction;

an internal roof support-walker assembly positioned inwardly of the formation adjacent the external deck assembly and having a forward portion facing a work face of the coal seam being mined;

power drive means for moving the internal support-walker assembly in said first direction;

carriage means mounted for horizontal reciprocation in said second direction adjacent the forward portion of the support-walker assembly;

a power driven rotary cutter head mounted on said carriage means; and conveyor means extending along said forward portion of the support walker beneath the rotary cutter head outwardly to a discharge end adjacent the forward end of the external deck assembly.

2. The invention of claim 1 wherein said internal roof support-walker assembly comprises a plurality of walking units each of which includes:

right and left elongated ground pads having longitudinal axes extending substantially parallel to the work face;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

power means for moving said right and left elongated ground pads in said second direction relative to each other;

a pair of right hydraulic cylinders extending between said elongated right ground pad and said right roof support pad for moving said right roof support pad vertically with respect to said right elongated pad; and wherein said conveyor extends in front of and perpendicular to the elongated ground pads and elongated roof support pads.

3. The invention of claim 1 wherein said internal roof support-walker assembly comprises a plurality of walking units each of which includes:

right and left elongated ground pads having longitudinal axes extending substantially parallel to the work face;

a panline conveyor frame unit mounted forwardly of said right and left elongated ground pads;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

power means for moving said right and left elongated ground pads in said second direction relative to each other;

a pair of right hydraulic cylinders extending between said elongated right ground pad and said right roof support pad for moving said right roof support pad vertically with respect to said right elongated pad; and wherein said conveyor extends through said conveyor frame unit in front of and perpendicular to the elongated ground pads and elongated roof support pads.

4. The invention of claim 1 wherein said internal roof support-walker assembly comprises a plurality of walking units each of which includes:

right and left elongated ground pads having longitudinal axes extending substantially parallel to the work face;

a panline conveyor frame unit mounted forwardly of said right and left elongated ground pads;

right and left elongated roof support pads respectively positioned above said right and left elongated ground pads;

a pair of hydraulic cylinders extending between said elongated left ground pad and said left roof support pad for moving the left roof support pad vertically with respect to the left ground pad;

power means for forming said right and left elongated ground pads in said second direction relative to each other;

a pair of right hydraulic cylinders extending between said elongated right ground pad and said right roof support pad for moving said right roof support pad vertically with respect to said right elongated pad; and wherein said conveyor extends through said panline conveyor frame unit in front of and perpendicular to the elongated ground pads and elongated roof support pads; and further including connector means connecting adjacent ones of said panline conveyor frame units.

5. The invention of claim 1 wherein said external roof support-walker assembly comprises a plurality of walking units each of which includes:

right and left elongated ground pads having longitudinal axes normally parallel to the work face;

a panline conveyor frame unit mounted forwardly of said right and left elongated ground pads;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right roof support pad vertically with respect to said right elongated pad; and ground pusher jack means mounted in one of said ground pads and operable for moving said one ground pad in said second direction with respect to the other ground pad; and wherein said conveyor extends through said panline conveyor frame unit in front of and perpendicular to the elongated ground pads and elongated roof support pads; and further including connector means connecting adjacent ones of said panline conveyor frame units.

6. The invention of claim 1 wherein said external roof support-walker assembly comprises a plurality of walking units each of which includes:

right and left elongated ground pads having longitudinal axes normally parallel to the work face;

a panline conveyor frame unit mounted forwardly of said right and left elongated ground pads;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right roof support pad vertically with respect to said right elongated pad; and ground pad pusher jack means mounted in one of said ground pads and operable for moving said one ground pad in said second direction with respect to the other ground pad;

walking unit push cylinder means mounted in one of said ground pads operable for moving the next adjacent pad of a next adjacent walking unit in said second direction;

wherein said conveyor extends through said panline conveyor frame unit in front of and perpendicular to the elongated ground pads and elongated roof support pads; and further including connector means connecting adjacent ones of said panline conveyor frame units.

7. The invention of claim 1 wherein said external roof support-walker assembly comprises a plurality of walking units each of which includes:

right and left elongated ground pads having longitudinal axes normally parallel to the work face;

a panline conveyor frame unit mounted forwardly of said right and left elongated ground pads;

a drag link connector connecting said panline conveyor frame unit to one of said elongated ground pads;

a panline pusher jack mounted in the other of said elongated ground pads to said panline conveyor frame unit for moving said panline conveyor frame unit in said first direction;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right roof support pad vertically with respect to said right elongated pad;

ground pad pusher jack means mounted in one of said ground pads and operable for moving said one ground pad in said second direction with respect to the other ground pad; and walking unit push cylinder means mounted in one of said ground pads operable for moving the next adjacent pad of a next adjacent walking unit in said second direction;

wherein said conveyor extends through said panline conveyor frame unit in front of and perpendicular to the elongated ground pads and elongated roof support pads; and further including connector means connecting adjacent ones of said panline conveyor frame units.

8. The invention of claim 1 wherein said external roof support-walker assembly comprises a plurality of walking units each of which includes:

right and left elongated ground pads having longitudinal axes normally parallel to the work face;

a panline conveyor frame unit mounted forwardly of said right and left elongated ground pads;

a canted scoop plate extending along the forward edge of the panline conveyor frame unit;

a drag link connector connecting said panline conveyor frame unit to one of said elongated ground pads;

a panline pusher jack mounted in the other of said elongated ground pads to said panline conveyor frame unit for moving said panline conveyor frame unit is said first direction so that the canted scoop plate picks up coal removed from the work face and deposits such coal on the conveyor;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right roof support pad vertically with respect to said right elongated pad;

ground pad pusher jack means mounted in one of said ground pads and operable for moving said one ground pad in said second direction with respect to the other ground pad; and walking unit push cylinder means mounted in one of said ground pads operable for moving the next adjacent pad of a next adjacent walking unit in said second direction;

wherein said conveyor means extends through said panline conveyor frame unit in front of and perpendicular to the elongated ground pads and elongated roof supports pad; and further including connector means connecting adjacent ones of said panline conveyor frame units.

9. The invention of claim 1 wherein said external roof support-walker assembly comprises a plurality of walking units each of which includes:

right and left elongated ground pads having longitudinal axes normally parallel to the work face;

a panline conveyor frame unit mounted forwardly of said right and left elongated ground pads;

a canted scoop plate extending along the forward edge of the panline conveyor frame unit;

a drag link connector connecting said panline conveyor frame unit to one of said elongated ground pads;

a panline pusher jack mounted in the other of said elongated ground pads to said panline conveyor frame unit for moving said panline conveyor frame unit in said first direction so that the canted scoop plate picks up coal removed from the work face and deposits such coal on the conveyor;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right roof support pad vertically with respect to said right elongated pad;

ground pusher jack means mounted in one of said ground pads and operable for moving said one ground pad in said second direction with respect to the other ground pad; and walking unit push cylinder means mounted in one of said ground pads operable for moving the next adjacent pad of a next adjacent walking unit in said second direction;

wherein said conveyor extends through said panline conveyor frame unit in front of and perpendicular to the elongated ground pads and elongated roof support pads; and further including:

connector means connecting adjacent ones of said panline conveyor frame units;

an idler sheave mounted on an inwardly positioned ground pad;

a cable loop extending over said idler sheave from first and second winches mounted on said external deck; and connector means on said cable loop for permitting connection of said cable loop to prefabricated roof supports for moving said supports beneath the overburden behind the support-walker assembly.

10. The invention of claim 1 wherein said external roof support-walker assembly comprises a plurality of walking units each of which includes:

right and left elongated ground pads having longitudinal axes normally parallel to the work face;

a panline conveyor frame unit mounted forwardly of said right and left elongated ground pads;

a canted scoop plate extending along the forward edge of the panline conveyor frame unit;

a drag link connector connecting said panline conveyor frame unit to one of said elongated ground pads;

a panline pusher jack mounted in the other of said elongated ground pads to said panline conveyor frame unit for moving said panline conveyor frame unit in said first direction so that the canted scoop plate picks up coal removed from the work face and deposits such coal on the conveyor;

right and left elongated roof support pads respectively positioned above said right and left elongated ground pads;

a canted scoop plate extending along the forward edge of the panline conveyor frame unit;

a drag link connector connecting said panline conveyor frame unit to one of said elongated ground pads;

a panline pusher jack mounted in the other of said elongated ground pads to said panline conveyor frame unit for moving said panline conveyor unit in said first direction so that the canted scoop plate picks up coal removed from the work face and deposits such coal on the conveyor;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right roof support pad vertically with respect to said right elongated pad;

ground pusher jack means mounted in one of said ground pads and operable for moving said one ground pad in said second direction with respect to the other ground pad; and walking unit push cylinder means mounted in one of said ground pads operable for moving the next adjacent pad of a next adjacent walking unit in said second direction;

wherein said conveyor extends through said panline conveyor frame unit in front of and perpendicular to the elongated ground pads and elongated roof support pads; and further including:

connector means connecting adjacent ones of said panline conveyor frame units;

an idler sheave mounted on an inwardly positioned ground pad;

a cable loop extending over said idler sheave from first and second winches mounted on said external deck;

connector means on said cable loop for permitting connection of said cable loop to prefabricated roof supports for moving said supports beneath the overburden behind the support-walker assembly; and a corner pivot jack having an overburden engaging top plate mounted on the inner end of the innermost panline conveyor frame unit.

11. The invention of claim 1 wherein said external roof support-walker assembly comprises a plurality of walking units each of which includes:

right and left elongated ground pads having longitudinal axes normally parallel to the work face;

a panline conveyor frame unit mounted forwardly of said right and left elongated ground pads;

a drag link connector connecting said panline conveyor frame unit to one of said elongated ground pads;

a panline pusher jack mounted in the other of said elongated ground pads to said panline conveyor frame unit for moving said panline conveyor frame unit in said first direction;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right roof support pad vertically with respect to said right elongated pad;

ground pad pusher jack means mounted in one of said ground pads and operable for moving said one ground pad in said second direction with respect to the other ground pad; and walking unit push cylinder means mounted in one of said ground pads operable for moving the next adjacent pad of a next adjacent walking unit in said second direction;

wherein said conveyor extends through said panline conveyor frame unit in front of and perpendicular to the elongated ground pads and elongated roof support pads; and further including:

connector means connecting adjacent ones of said panline conveyor frame units; and connector links drivingly connecting the right ground pad of each walking unit to the right ground pad of the next adjacent walking unit.

12. The invention of claim 1 wherein said external deck forward drive means comprises:

first and second ground pontoons;

a pair of hydraulic lift cylinders connecting each of said ground pontoons to said external deck assembly for vertical movement with respect thereto so that movement of the ground pontoon to a lower limit position effects lifting movement of the external deck assembly so that it is supported by the ground pontoons;

a pair of parallel slide members mounted on said external deck assembly for reciprocation in said first direction with respect to said external deck assembly with each pair of hydraulic lift cylinders being respectively mounted on one of said slide members; and deck shift cylinders for effecting relative shifting movement of said slide members with respect to said external deck.

13. The invention of claim 1 wherein said external deck forward drive means comprises:

first and second ground pontoons;

a pair of hydraulic lift cylinders connecting each of said ground pontoons to said external deck assembly for vertical movement with respect thereto so that movement of the ground pontoon to a lower limit position effects lifting movement of the external deck assembly so that it is supported by the ground pontoons;

a pair of parallel slide members mounted on said external deck assembly for reciprocation in said first direction with respect to said external deck assembly with each pair of hydraulic lift cylinders being respectively mounted on one of said slide members;

deck shift cylinders for effecting relative shifting movement of said slide members with respect to said external deck;

wherein said external deck inward-outward drive means comprises:

third and fourth ground pontoons;

a pair of hydraulic lift cylinders connected to each of said third and fourth ground pontoons and to said external deck assembly for vertical movement with respect thereto so that movement of the ground pontoon to a lower limit position effects or maintains the external deck assembly supported by the third and fourth ground pontoons;

a second pair of parallel slide members mounted on said external deck assembly for reciprocation in said second direction with respect to said external deck assembly with each pair of hydraulic lift cylinders connected to said third and fourth ground pontoons being respectively mounted on one of said second pair of slide members; and a second group of deck shift cylinders for effecting relative shifting movement of said second pair of slide members in said second direction with respect to said external deck.

14. The invention of claim 13 wherein said external roof support-walker assembly comprises a plurality of walking units each of which includes:

right and left elongated ground pads having longitudinal axes normally parallel to the work face;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right food support pad vertically with respect to said right elongated pad; and wherein said conveyor extends in front of and perpendicular to the elongated ground pads and elongated roof support pads.

15. The invention of claim 13 wherein said external roof support-walker assembly comprises a plurality of walking units each of which includes:

right and left elongated ground pads having longitudinal axes normally parallel to the work face;

a panline conveyor frame unit mounted forwardly of said right and left elongated ground pads;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right roof support pad vertically with respect to said right elongated pad; and wherein said conveyor extends through said conveyor frame unit in front of and perpendicular to the elongated ground pads and elongated roof support pads.

16. The invention of claim 13 wherein said external roof support-walker assembly comprises a plurality of walking units each of which includes:

right and left elongated ground pads having longitudinal axes normally parallel to the work face;

a panline conveyor frame unit mounted forwardly of said right and left elongated ground pads;

right and left elongated roof support pads respectively positioned above said right and left elongated ground pads;

a pair of hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right roof support pad vertically with respect to said right elongated pad; and wherein said conveyor extends through said panline conveyor frame unit in front of and perpendicular to the elongated ground pads and elongated roof support pads; and further including connector means connecting adjacent ones of said panline conveyor frame units.

17. The invention of claim 13 wherein said external roof support-walker assembly comprises a plurality of walking units each of which includes:

right and left elongated ground pads having longitudinal axes normally parallel to the work face;

a panline conveyor frame unit mounted forwardly of said right and left elongated ground pads;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right roof support pad vertically with respect to said right elongated pad; and ground pusher jack means mounted in one of said ground pads and operable for moving said one ground pad in said second direction with respect to the other ground pad; and wherein said conveyor extends through said panline conveyor frame unit in front of and perpendicular to the elongated ground pads and elongated roof support pads; and further including connector means connecting adjacent ones of said panline conveyor frame units.

18. The invention of claim 13 wherein said external roof support-walker assembly comprises a plurality of walking units each of which includes:

right and left elongated ground pads having longitudinal axes normally parallel to the work face;

a panline conveyor frame unit mounted forwardly of said right and left elongated ground pads;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right roof support pad vertically with respect to said right elongated pad; and ground pad pusher jack means mounted in one of said ground pads and operable for moving said one ground pad in said second direction with respect to the other ground pad;

walking unit push cylinder means mounted in one of said ground pads operable for moving the next adjacent pad of a next adjacent walking unit in said second direction;

wherein said conveyor extends through said panline conveyor frame unit in front of and perpendicular to the elongated ground pads and elongated roof support pads; and further including connector means connecting adjacent ones of said panline conveyor frame units.

19. The invention of claim 13 wherein said external roof support-walker assembly comprises a plurality of walking units each of which includes:

right and left elongated ground pads having longitudinal axes normally parallel to the work face;

a panline conveyor frame unit mounted forwardly of said right and left elongated ground pads;

a canted scoop plate extending along the forward edge of the panline conveyor frame unit;

a drag link connector connecting said panline conveyor frame unit to one of said elongated ground pads;

a panline pusher jack mounted in the other of said elongated ground pads to said panline conveyor frame unit for moving said panline conveyor frame unit in said first direction so that the canted scoop plate picks up coal removed from the work face and deposits such coal on the conveyor;

right and left elongated roof support pads respectively positioned above said right and left elongated ground pads;

a pair of left hydraulic cylinders extending between said elongated left ground pad and said left roof support pad for moving the left roof support pad vertically with respect to the left ground pad;

a pair of right hydraulic cylinders extending between said elongated right ground pad and said right roof support pad for moving said right roof support pad vertically with respect to said right elongated pad;

ground pusher jack means mounted in one of said ground pads and operable for moving said one ground pad in said second direction with respect to the other ground pad; and walking unit push cylinder means mounted in one of said ground pads operable for moving the next adjacent pad of a next adjacent walking unit in said second direction;

wherein said conveyor extends through said panline conveyor frame unit in front of and perpendicular to the elongated ground pads and elongated roof support pads; and further including;

connector means connecting adjacent ones of said panline conveyor frame units;

an idler sheave mounted on an inwardly positioned ground pad;

a cable loop extending over said idler sheave from first and second winches mounted on said external deck; and connector means on said cable loop for permitting connection of said cable loop to prefabricated roof supports for moving said supports beneath the overburden behind the support-walker assembly.

20. A method of mining a mineral seam capped by an overburden and having a peripheral edge surface comprising the steps of:

A. providing a work face in the mineral seam substantially perpendicular to the peripheral edge surface;

B. moving a cutter head along the work face in a cutting direction substantially perpendicular to the peripheral edge surface to effect separation of particles of the mineral from the seam by a predetermined distance forwardly from the work surface to provide a new work face while supporting the overburden with movable roof supports adjacent the work face;

C. moving the cutter head to a position outward of the peripheral edge surface;

D. moving the cutter head and the movable roof supports in a direction substantially parallel to the peripheral edge surface a distance equal to said predetermined distance;

E. moving the cutter head in said cutting direction along the new work face to effect separation of mineral particles therefrom;

F. moving the prefabricated roof supports inwardly in a direction generally perpendicular of said peripheral edge surface to a position beneath the overburden following step D; and G. permitting the overburden to settle on the prefabricated roof supports as steps B, C and D are repeated.

21. The method of claim 20 wherein said movement of the movable roof supports in step D is effected by:

H. lowering a first group of the movable roof supports from contact with the overburden;

I. moving the first group of movable roof supports said predetermined distance in a direction substantially parallel to the peripheral edge surface;

J. raising the first group of roof supports into contact with the overburden;

K. lowering the second group of movable roof supports from contact with the overburden;

L. moving the first group of movable roof supports said predetermined distance in said direction substantially parallel to the peripheral edge surface; and M. raising said second group of movable roof supports into contact with the overburden.

22. The method of claim 21 wherein said first and second groups of movable roof supports are interleaved with respect to each other.

23. The method of claim 20 wherein said movement of the movable roof supports in step D is effected by:

H. lowering a first group of the movable roof supports from contact with the overburden;

I. moving the first group of movable roof supports said predetermined distance in a direction substantially parallel to the peripheral edge surface;

J. raising the first group of roof supports into contact with the overburden;

K. lowering the second group of movable roof supports from contact with the overburden;

L. moving the first group of movable roof supports said predetermined distance in said direction substantially parallel to the peripheral edge surface concurrently with the movement of the cutter head in step D; and M. raising said second group of movable roof supports into contact with the overburden.

24. The method of claim 23 wherein said first and second groups of movable roof supports are interleaved with respect to each other.

25. The method of claim 20 including the step of moving a mineral removing conveyor said predetermined distance in said direction substantially parallel to the peripheral edge surface concurrently with step D.

26. The method of claim 25 wherein said movement of the movable roof supports in step D is effected by:

H. lowering a first group of the movable roof supports from contact with the overburden;

I. moving the first group of movable roof supports said predetermined distance in a direction substantially parallel to the peripheral edge surface;

J. raising the first group of roof supports into contact with the overburden;

K. lowering the second group of movable roof supports from contact with the overburden;

L. moving the first group of movable roof supports said predetermined distance in said direction substantially parallel to the peripheral edge surface; and M. raising said second group of movable roof supports into contact with the overburden.

27. The method of claim 26 wherein said first and second groups of movable roof supports are interleaved with respect to each other.

28. The method of claim 25 wherein said movement of the movable roof supports in step D is effected by:

H. lowering a first group of the movable roof supports from contact with the overburden;

I. moving the first group of movable roof supports said predetermined distance in a direction substantially parallel to the peripheral edge surface;

J. raising the first group of roof supports into contact with the overburden;

K. lowering the second group of movable roof supports from contact with the overburden;

L. moving the first group of movable roof supports said predetermined distance in said direction substantially parallel to the peripheral edge surface concurrently with the movement of the cutter head in step D; and M. raising said second group of movable roof supports into contact with the overburden.

29. The method of claim 28 wherein said first and second groups of movable roof supports are interleaved with respect to each other.

* * * * *